United States Patent [19]

Mitchell

[11] Patent Number: 4,945,694

[45] Date of Patent: Aug. 7, 1990

[54] BUILDING MODULE

[76] Inventor: John Mitchell, 1 Devonshire Pl., Suite 3917, Boston, Mass. 02109

[21] Appl. No.: 340,758

[22] Filed: Apr. 20, 1989

[51] Int. Cl.[5] ..... E04C 3/10

[52] U.S. Cl. ..... 52/223 R

[58] Field of Search ..... 52/685, 227–230, 52/687, 454, 223 R; 264/228

[56] References Cited

U.S. PATENT DOCUMENTS 2,950,517 8/1960 Brickman ..... 264/228
3,950,584 4/1976 Bramley ..... 428/11

FOREIGN PATENT DOCUMENTS 1124819 8/1968 United Kingdom ..... 52/454
2006314 5/1979 United Kingdom ..... 52/685

*Primary Examiner*—James L. Ridgill, Jr.
*Attorney, Agent, or Firm*—Paul J. Cook

[57] ABSTRACT

A composite building module is provided formed of a cured cement matrix containing one or more prestressed metal wire meshes. Discrete foamed members are formed on the wire mesh at spaced apart locations laong the length of the wire mesh.

16 Claims, 2 Drawing Sheets

BUILDING MODULE

BACKGROUND OF THE INVENTION

This invention relates to a composite building module comprising cured concrete, prestressed metal wires and discrete foam members.

Prior to the present invention, foam materials have been incorporated within a cement composition with the object of forming light weight cement-based building modules which retain desired strength. The foam material has been incorporated as a continuous layer or as a block within a cement matrix in order to render the resultant composite more lightweight and, more resistant to water permeation through the resultant composite structure. Examples of such composites are shown for example, in U.S. Pat. Nos. 3,943,676 and 4,186,536. A significant disadvantage of these structures is that the low density foam is concentrated within a continuous portion of the volume of the composite rather than being distributed throughout the cement matrix. This results in a composite having relatively low mechanical strength within a significant portion of the composite volume caused by the low mechanical strength at the foam-cement interface. When failure occurs at a portion of this interface, the failure can easily extend along a significant portion of the interface area which can cause failure of the entire composite.

Attempts to directly mix liquid cement and discrete particles of polymeric foam have not been successful since it is difficult to wet the particle surfaces, and, as a result they tend to migrate at or near the cement matrix surface. Thus, prior to the invention, a relatively homogenous matrix of cement and foam material has not been available.

It would be desireable to provide cement-foam composites wherein position of the foam portion can be easily controlled and wherein the foam portion is homogeneously distributed throughout the cement matrix. In addition, it would be desireable to provide such composites wherein the homogeneity of foam distribution is maintained when utilizing means for prestressing the concrete-foam composite.

SUMMARY OF THE INVENTION

A composite building module is provided which comprises a molded cement matrix, a wire matrix extending through the cement matrix and a plurality of discrete foam members positioned and homogeneously distributed on the wire mesh. The composite is relatively light weight and has improved sound insulating characteristics. The wire matrix can extend in one, two or three dimensions throughout the concrete matrix. The module is formed by positioning the wire matrix within a mold and thereafter injection molding a plastic foamable composition into a plurality of mold cavities in the mold at discrete locations on the wire matrix. The plastic foamable composition is allowed to cure into a rigid foam structure and the mold is removed from the wire matrix. The wire matrix together with the discrete foam structure thereon are placed in a mold for a cement composition, the wire mesh is subjected to tension forces and the cement composition is poured into the mold and cured to solidification. Tension is then released from the wire mesh and the resultant composite building module is removed from the mold. In one aspect of the present invention small premolded rigid plastic foam structures having metal wires molded within and extending from the surface of the stuctures are intimately admixed in the mold with the cement composition while it is fluid. The extended wires substantially reduce the migration of the foam structure within the mold as compared with such foam structures free of extended wire. While this invention is described herein with reference to concrete, it is to be understood that it is also useful with other building materials such as baked clay or baked earth such as in Third World countries.

DESCRIPTION OF SPECIFIC EMBODIMENTS

Figure 1:
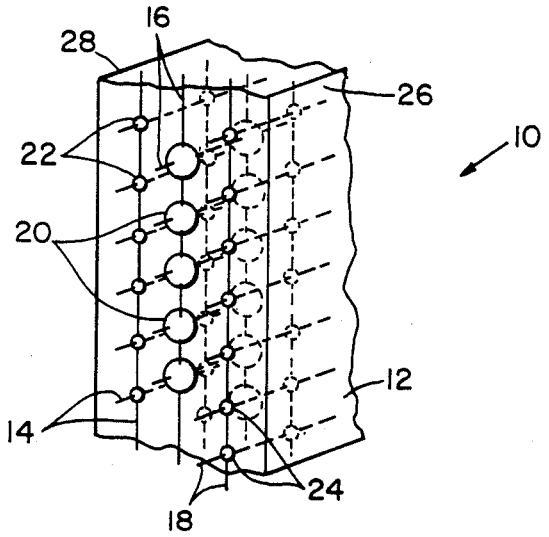
FIG. 1 is a perspective view of a building module of this invention.

In accordance with this invention, the building module is formed by first producing a wire mesh matrix upon which is molded discrete foam members which are spaced-apart from each other and through which the wire mesh extends. The wires forming the wire mesh are positioned within an injection mold shaped to accept the wires and having discrete cavities the desired size of the foam member to be formed along the length of the wires. A resin composition adapted to be converted within the mold cavity to a rigid plastic foam then is injected into each cavity. The resin composition is cured within the mold such a by heating the mold in a conventional manner. Typically curing can be completed within about fifteen minutes. Representative suitable foam resins include foamed polyurethane, polystyrene, polyester, polyolefins and phenolic resins. Upon curing, the foam resin is securely adhered to the metal wire mesh, particularly when the foamed member is positioned at the intersection of a plurality of wires and the foam member encloses the wire intersection. Typically, the foam member is shaped as a sphere but can be any shape and typically has a major diameter between about ½ inch and 2 inches. The size of the foamed member and the distance between them along the length of a wire will depend upon the design strength and weight requirements of the building module produced. Higher concentration of the foam member results in modules of decreased strength and weight. The formation of the foam members on the wire matrix can be effected with or without stress on the wire or with tension stress on the wires. When the wires are subjected to tension stress during the step of forming the foam members and maintained under this tension stress during the subsequent steps described below, there is no relative movement between the wire mesh and foam members after the cement composition has cured.

The wire mesh with foam member molded thereto is removed from the injection mold and positioned in a mold for shaping a cement composition. The wire mesh is preferably subjected to tension forces in order to form a prestressed building module. A cement composition is poured into the mold and is allowed to cure to form a solid building module comprising the cement matrix, the wire mesh and the foam members.

The building module of this invention can include one or a plurality of separate wire mesh structures each of which can extend in two directions and which are formed from two sets each of a plurality of wires. The sets of wires preferably intersect each other at an angle substantially 90 degrees. In addition, the term "wire mesh" as used herein includes a plurality of separate nonintersecting wires which extend parallel to each other.

In one embodiment of this invention, individual foam members which are molded on one or a plurality of small wires which extend typically from ⅛ inch to 2 inches from the foam member surface can be intimately mixed with the fluid cement composition and poured into the final mold into contact with the wire mesh having foam members molded therein. The small wires extending from the individual foam members are wet by the concrete composition and retard the tendency of these particles from floating to the exposed surface of the fluid concrete composition. The individual foam members provide a means for more finely regulating the density of the building module.

The cement composition preferably is commonly available cement with conventional fillers such as sand or pumice and can contain conventional additives such as lime and stearate for water resistance, latex for added strength, a wetting agent such as methyl cellulose or water reducing agents, dyes or tints.

Referring to FIG. 1, the building module of this invention 10 comprises a solid cement matrix 12 through which is interspersed one or more wire matrices 14, 16 and 18. Each wire matrix 14, 16 and 18 comprises two sets of a plurality of parallel wires which intersect each other at an angle substantially 90 degrees. Wire matrix 16 is positioned nearest the central portion of module 10 where the module 10 experiences the least stress when it is in use. Thus, the foam members 20 can be made larger than the foam members 22 and 24 since the strength requirements within the central portion of the module 10 are less than the strength requirements nearer the surfaces 26 and 28 of the module 10. The foam members 20, 22 and 24 are positioned at the intersection of two wires of each wire mesh 14, 16 and 18.

Figure 2:
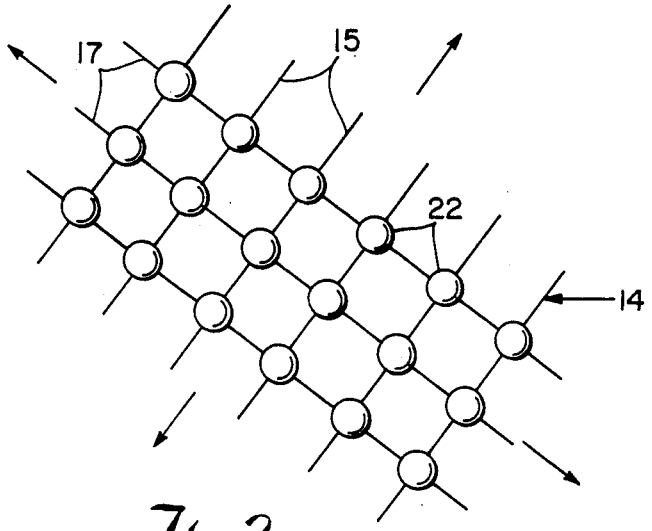
FIG. 2 is a top view of a wire mesh-foam member component of the module of this invention.

As shown in FIG. 2, the wire mesh 14 includes a first set of parallel wires 15 and a second set of parallel wire 17 which intersect each other. The foam members are positioned at the intersections of wires 15 and 17. During formation of the foam members 22, the wires 15 and 17 can be subjected to tension forces to prestress the wires.

Figure 3:
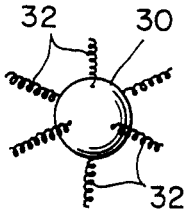
FIG. 3 is a perspective view of a foam component of an alternative embodiment of this invention.

Referring to FIG. 3, an alternative embodiment of this invention is shown. As noted above, foam members 30 having protruding wires 32 can be admixed with the fluid cement composition to form a homogenous dispersion which then is cured in contact with the wire mesh containing the foam members.

Figure 4:
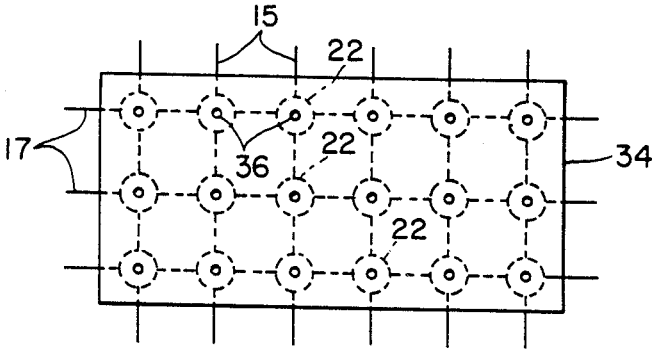
FIG. 4 is a top view of a mold useful for making the component of FIG. 2.

Referring to FIG. 4, an injection mold 34 is shown having an inner mold shape adapted to accomodate wires 15 and 17 and, at the intersections of wires 15 and 17, having a spherical shape. Inlets 36 are provided at each spherically shaped portion of the mold in order to permit injection of a foamable plastic composition into each spherical shaped mold portion. The foamable composition is cured within the mold 34 and, thereafter, the wire mesh formed by wires 15 and 17 as well as the foam members 22 molded thereon are removed from the mold 34.

Figure 5:
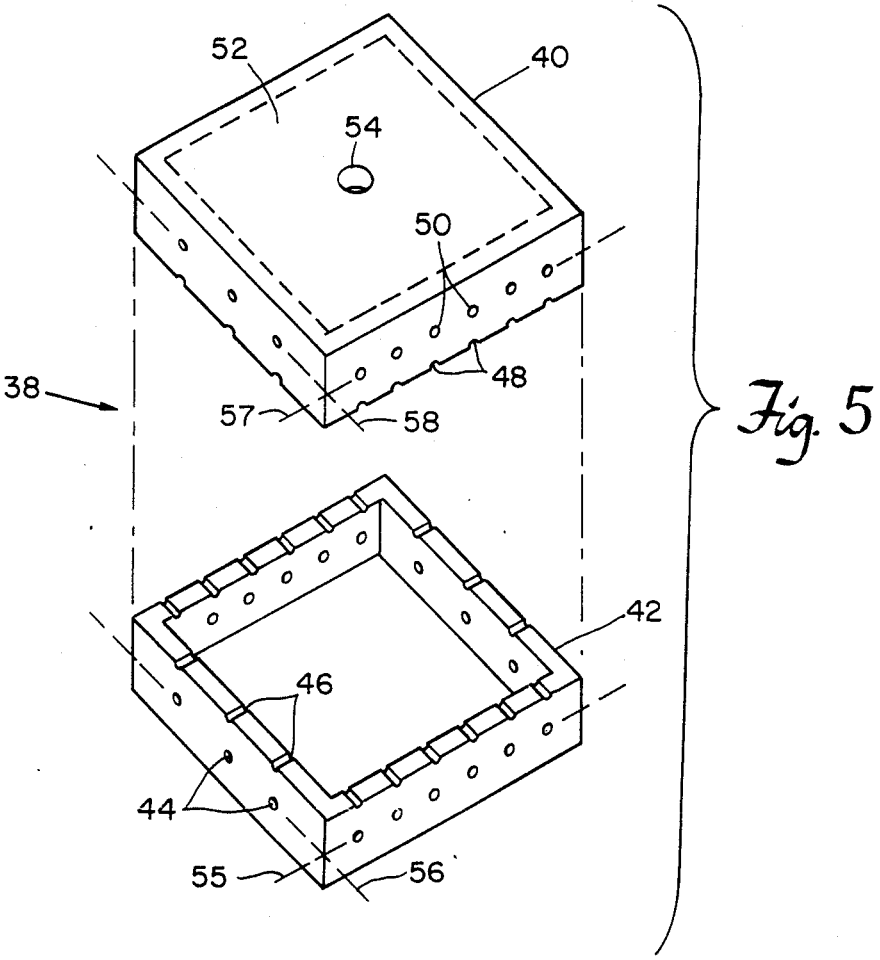
FIG. 5 is a perspective view of a mold useful for making the module of FIG. 1.

Referring to FIG. 5, the mold 38 for the cement composition is shown. The mold 38 comprises a top portion 40 and a bottom portion 42. The bottom portion includes holes 44 through which extend the end portions of wire mesh 14 and semicircular holes 46 which mate with semicircular holes 48 on top portion 40 to form holes through which the ends of wire mesh 16 extend. The top mold portion 40 also is provided with holes 50 through which extend the ends of with mesh 18. The top portion 40 also is provided with a removable lid 52 having a hole 54 therein to permit introduction of a fluid cement composition into mold 38. Mold 38 also can be formed with four mold pieces with the additional pieces being formed at lines 55 and 56 through holes 44 and at lines 57 and 58 through holes 50. This four piece embodiment permit introduction of prestressed wire meshes from the mold for the foamable composition without reduction of the tensile forces on the wire mesh from the mold for the foamable composition to the mold for the cement composition.

I claim:

1. A composite building module which comprises a shaped cured matrix selected from the group consisting of cement, baked clay and baked earth, a plurality of metal wired prestressed under tensile forces, said metal wires extending through said cured matrix and secured under said tensile forces by said cured matrix and a plurality of discrete solid foam members positioned and spaced apart from each other along the length of said wires.

2. The module of claim 1 which includes within said cured matrix discrete free foam members uniformly interspersed within said cured matrix, said free foam members having a plurality of wires protruding from the surface of said free foam members.

3. The module of claim 1 wherein said wires extend in the same direction.

4. The module of claim 3 which includes within said cured matrix discrete free foam members uniformly interspersed within said cured matrix, said free foam members having a plurality of wires protruding from the surface of said free foam members.

5. The module of claim 3 wherein the matrix is cement.

6. The module of claim 5 which includes within said cured matrix discrete free foam members uniformly interspersed within said cured matrix, said free foam members having a plurality of wires protruding from the surface of said free foam members.

7. The module of claim 1 which includes a first set of wires and a second set of wires wherein said first set and said second set are positioned approximately at right angles to each other.

8. The module of claim 7 which includes within said cured matrix discrete free foam members uniformly interspersed within said cured matrix, said free foam members having a plurality of wires protruding from the surface of said free foam members.

9. The module of claim 7 wherein the matrix is cement.

10. The module of claim 9 which includes within said cured matrix discrete free foam members uniformly interspersed within said cured matrix, said free foam members having a plurality of wires protruding from the surface of said free foam members.

11. The module of claim 1 which includes a first set of wires and a second set of wires wherein the foam members in said first set of wires are smaller than the foam members on said second set of wires.

12. The module of claim 11 which includes within said cured matrix discrete free foam members uniformly interspersed within said cured matrix, said free foam members having a plurality of wires protruding from the surface of said free foam members.

13. The module of claim 11 wherein the matrix is cement.

14. The module of claim 13 which includes within said cured matrix discrete free foam members uniformly interspersed within said cured matrix, said free foam members having a plurality of wires protruding from the surface of said free foam members.

15. The module of claim 1 wherein the matrix is cement.

16. The module of claim 15 which includes within said cured matrix discrete free foam members uniformly interspersed within said cured matrix, said free foam members having a plurality of wires protruding from the surface of said free foam members.

* * * * *